United States Patent [19]

Crow

[11] Patent Number: 4,475,606

[45] Date of Patent: Oct. 9, 1984

[54] DRAG BIT

[75] Inventor: Morgan L. Crow, Dallas, Tex.

[73] Assignee: Dresser Industries, Inc., Dallas, Tex.

[21] Appl. No.: 406,722

[22] Filed: Aug. 9, 1982

[51] Int. Cl.[3] ..... E21B 10/46

[52] U.S. Cl. ..... 175/410

[58] Field of Search ..... 175/376, 378, 410, 329, 175/330, 377, 397, 398, 399, 57; 76/108 A, 101 E

[56] References Cited

U.S. PATENT DOCUMENTS

| | | | |
|---|---|---|---|
| 2,264,617 | 12/1941 | Carpenter et al. | 175/329 |
| 3,106,973 | 10/1963 | Christensen | 175/330 |
| 3,158,216 | 11/1964 | Baron et al. | 175/402 |
| 3,871,488 | 3/1975 | Sabre | 175/406 |
| 3,885,638 | 5/1975 | Skidmore | 175/390 |
| 4,051,912 | 10/1977 | White | 175/410 |
| 4,073,354 | 2/1978 | Rowley et al. | 175/329 |
| 4,248,314 | 2/1981 | Cunningham | 175/378 |
| 4,253,533 | 3/1981 | Baker | 175/329 |

OTHER PUBLICATIONS

Sandia Laboratories, "Stratapax TM Computer Program", (SAND77-1994), Apr. 1978, by Richard F. Ashmore, Dr. K. W. Chase and D. L. Mahlum.

"Optimisation of Radial Distribution of Stratapax (TI) Cutters in Rock Drilling Bits", Feb. 1, 1980, by J. D. Barr.

*Primary Examiner*—George A. Suchfield

*Assistant Examiner*—Michael Starinsky

*Attorney, Agent, or Firm*—Fred A. Winans

[57] ABSTRACT

A design for a drill bit (10) is provided. The design permits placement of a plurality of cutters (14) in a pattern approaching an ideal equal volume cutting arrangement while minimizing the mathematical steps necessary to calculate the desired positions. The design positions the cutters so that the annular area between radially adjacent cutters is a constant. Certain groups of cutters can also be positioned to prevent a central core in the material drilled and to provide a desired kerf overlap.

10 Claims, 8 Drawing Figures

DRAG BIT

TECHNICAL FIELD

This invention relates to the design of drill bits, and in particular to the distribution of earth boring cutting surfaces on the drill bit.

BACKGROUND OF THE INVENTION

Many earth boring drill bits and particularly those commonly known as drag bits, are designed currently with cutting surfaces comprising a plurality of polycrystalline diamond faced cutters, each mounted on a tungsten carbide stud. The drill bit includes apertures or holes adapted to receive the studs. A significant effort has been made to distribute the individual cutters about the drill bit to provide the most efficient operation. In particular, a design goal is to maintain uniform wear on the cutters to maximize the service life of the drill bit. To obtain such uniform wear, each individual cutter should cut equal volumes of material.

In the past, designers have spaced cutters at uniform increments along radii extending from the central axis of the drill bit. This design has not been found to be completely effective. An attempt to empirically determine an optimum cutter distribution was made in a technical paper entitled "Optimization of Radial Distribution of Stratapax Cutters and Rock Drilling Bits" by J. D. Barr. This paper was presented to the Energy-sources Technology Conferences, at New Orleans in February, 1980. In this paper, a power law model was assumed to relate cutter wear rate to cutter velocity and area of cut. In the paper, the distribution of cutters was made according to the following formula:

$$1/S = K_3 R^E$$

where $E = b/c$

In this formula, S is the radial spacing between cutters, $K_3$ is an empirical constant, R is the distance of the cutting edge from the central axis of the bit, E is a spacing exponent, b is a velocity exponent and c is an area exponent. An upper limit for the value of S is selected at about $\frac{1}{3}$ or $\frac{1}{4}$ of the cutter diameter. This ensures adequate redundancy in the event of loss of a particular cutter, or even two adjacent cutters. A disadvantage of the design method disclosed in this paper is the requirement for empirical wear measurements from used bits in the particular material to be drilled. Also, experiments undertaken by the author of the paper and summarized therein resulted in considerable scatter from theoretical wear patterns.

Another approach to the distribution of cutters on drill bits is described in a publication released by Sandia Laboratories. This publication is entitled "Stratapax TM Computer Program" and authored by Richard F. Ashmore et al. The publication is identified by a number SAND77-1994 and was printed in April, 1978.

This publication records a complex computer program which calculates the volume of material cut by each cutter on a drill bit. A number of variables can be input into the computer program. These variables include the location of the cutter in radial distance from the central axis of the bit, the angular location of the individual cutters from an arbitrary base line in a plane perpendicular to the central axis of the bit and the position of the individual cutters along the length of the bit. The computer program can optimize the positioning of a number of cutters by trial and error iteration to achieve equal volume cut for each cutter.

However, the computer program has several disadvantages. An operator must first select a pattern of cutter distribution to initialize the computer program. The initial selection of cutter position affects the usefulness of the iteration technique. In addition, sophisticated and expensive computer facilities must be available to the designer.

A need exists for a simplified, yet effective design for placement of the cutters on the drill bit. The design should avoid the complications of empirical data which require expensive and time consuming test programs. In addition, the design should avoid complex and expensive calculations which require specialized and expensive computing equipment.

SUMMARY OF THE INVENTION

In accordance with one aspect of the present invention, a drill bit is provided. The drill bit includes a body having a central axis and a plurality of cutters for attachment to the body. The cutters each include a cutting face for contacting a material to be drilled. Each cutter defines a circle of revolution, as the bit is rotated, centered on the central axis of the bit with a radius extending to the center of the cutting face of the cutter. The cutters are distributed on the body so that the difference in area for the circle of a given cutter and either the next greater circle area or next lesser circle area defined by a radially adjacent cutters is constant.

In accordance with another aspect of the present invention, the cutters on the drill bit are positioned so that the distance between the radius of a given cutter and the next lesser radius of a radially adjacent cutter does not exceed the radial length of the cutting face of either cutter to provide overlap. In particular, the difference should be no more than 60% of the radial length of the cutting face of either cutter.

In accordance with yet another aspect of the present invention, a method is provided for positioning cutters on a drill bit. The drill bit includes a body with a central axis. The method includes the step of mounting the cutters on the body so that the centers of the cutting faces thereof define a circle of revolution for each cutter centered on the central axis having a radius extending to the center of the cutting face, the difference in areas between a circle defined by a given cutter and the next greater area of an adjacent cutter and the next lesser area of an adjacent cutter is constant.

In accordance with still another aspect of the present invention, a drill bit is provided. The drill bit includes a body having a central axis and a plurality of cutters for attachment to the body at different locations along the bit axis. Each cutter includes a cutting face for contacting a material to be drilled. Each cutter is positioned at a predetermined radial distance measured from the central axis of the body to the center of the cutting face perpendicular the central axis. The annular area projected to a common plane perpendicular to the axis between the circles defined by radially adjacent cutters is constant.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
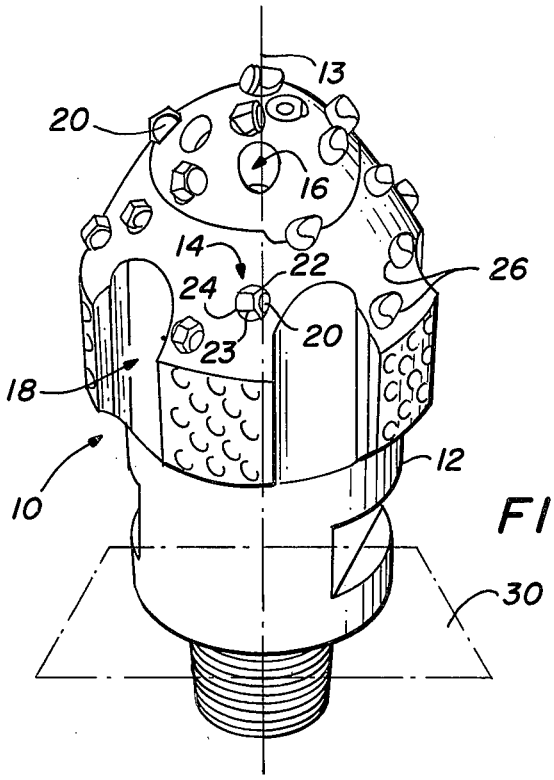
FIG. 1 is a perspective view of a drill bit designed in accordance with the present invention.

Referring now to the Drawings, wherein like reference characters designate like or corresponding parts throughout several views, FIG. 1 illustrates a drill bit 10. The drill bit 10 includes a steel body 12. The central axis 13 extends through the body 12 and acts as the axis about which the drill bit is rotated. A plurality of individual cutters 14 are mounted on the body 12 as illustrated in a distribution that will be described hereinafter.

Circulation ports 16 extend through the face of the drill bit 10 which permit drilling mud to flow from the surface to the working face of the material being drilled. Grooves 18 at the outer periphery of the drill bit 10 permit the drilling mud and cuttings from the working face to pass therethrough and move to the surface for disposal.

The cutters include a cutting face 20 which is commonly formed of a polycrystalline diamond compound 22. The diamond compound 22 is mounted on a tungsten carbide disc 23 which is bonded to a tungsten carbide stud 24 which is fit into apertures 26 in the body 12 by means well known in the art. Cutters of this type can be obtained from the General Electric Company under the tradename STRATAPAX TM.

As noted previously, the distribution of the cutters 14 on the drill bit 10 is critical to the effective and efficient operation of the drill bit. If too much stress or wear is encountered on individual cutters, the drill bit can be rendered ineffective long prior to the expected service life of the drill bit. The design goal is to achieve uniform wear on each cutter to maximize the service life and effectiveness of the drill bit.

Figure 2:
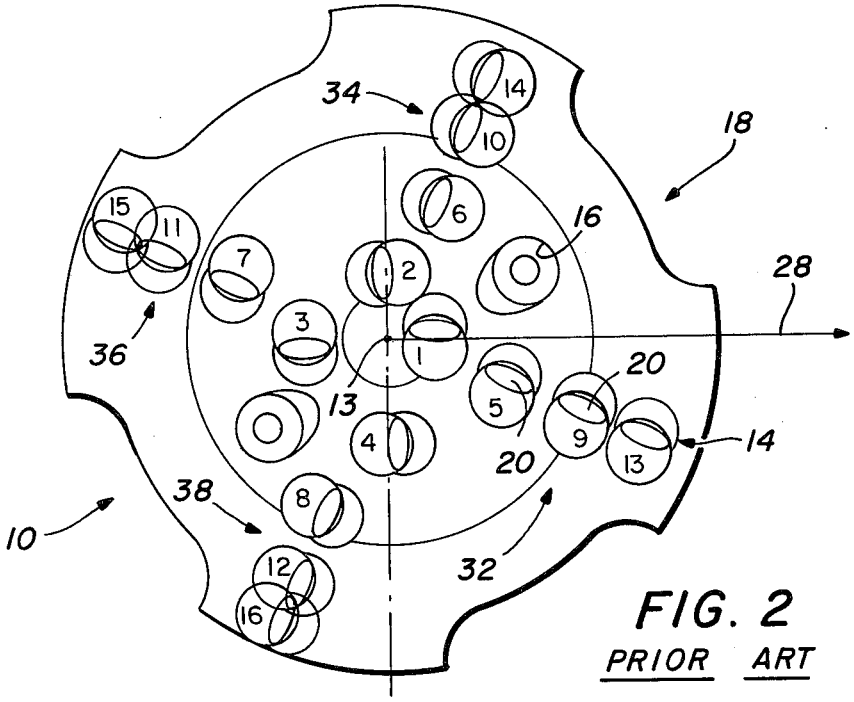
FIG. 2 PRIOR ART
FIG. 2 is an end view of a prior art design for cutter distribution on a drill bit.
Figure 3:
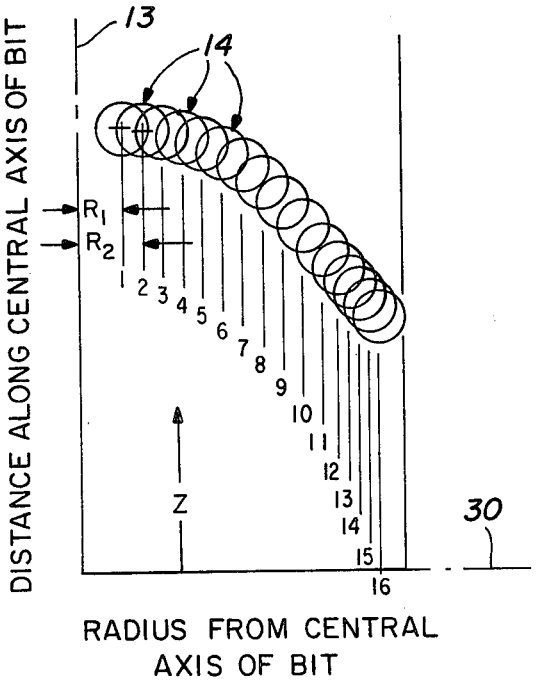
FIG. 3 PRIOR ART
FIG. 3 is a profile drawing of the drill bit of FIG. 2 illustrating the cutters on the drill bit rotated to a single radius from the central axis.

A prior art design for a drill bit is illustrated in FIGS. 2 and 3 with exact dimensions recorded in Table 1 below. The dimensions recorded in Table 1 are in inches. The prior art design assumes a hole diameter or diameter to be drilled of 6.5 inches. Each cutting face 20 is assumed to be circular and have a diameter of 0.5 inches. The calculations were made for a 16 cutter bit.

The cutters 14 are located on the drill bit by cylindrical coordinates measured from the central axis 13 of the body to the center of the cutting face of the cutter. The cylindrical coordinates include the radius ($R_1$ through $R_{16}$) centered on the central axis 13 and extending to the center of the cutting face 20 and the angle of the radius measured from an arbitrary radial line 28, counterclockwise as illustrated in FIG. 2.

The value of Z is the position of the cutting face for each cutter from an arbitrary plane 30 perpendicular to the central axis 13. It is noted that the value of Z continuously decreases from the radially innermost cutter to the radially outermost cutter, with the R and Z dimensions generally corresponding to the profile of the bit 10. The DR value in the table is the difference in the radius of a given cutter from the radius of the radially adjacent cutter having a lesser radius. The radially adjacent cutters to a given cutter are those cutters which have either the next lesser radial location from the central axis or the next greater radius from the central axis from the given cutter. For example, cutters 8 and 10 are radially adjacent to cutter 9 although distributed about the face of the drill bit.

The DA value is the annular area that represents the difference in area of a circle centered on the central axis having a radius equal to the radius extending to the center of a cutting face of a cutter and the similar circle defined by the cutter radially adjacent having the lesser radius if each cutting face were to lie in a single plane (i.e. plane 30) perpendicular to the central axis (i.e. if the Z value were constant). The DA value is directly related to the volume that each cutter must remove from the material being drilled for each rotation of the drill bit.

It will be observed that the cutters 14 distributed on the drill bit 10 in FIG. 2 are distributed in four radial wings 32, 34, 36 and 38. The number and configuration of the wings is designed to maintain the center of mass of the drill bit on the central axis to avoid centrifugally induced forces during drill bit rotation which would tend to divert the path of the drill bit. In addition, the distribution attempts to reduce torque variations in the drill string rotating the drill bit as individual cutters are exposed to variations in the cross-section of material to be cut. However, the wing design is not critical to the present invention.

TABLE I

| CUTTER NO. | RADIUS | ANGLE | Z VALUE | DR | DA |
|---|---|---|---|---|---|
| 1 | .4500 | 0 | 12.0000 | .45000 | .63705 |
| 2 | .6500 | 90 | 11.9944 | .20000 | .69210 |
| 3 | .8500 | 180 | 11.9691 | .20000 | .94378 |
| 4 | 1.0500 | 270 | 11.9229 | .20000 | 1.19545 |
| 5 | 1.2500 | 337 | 11.8540 | .20000 | 1.44713 |
| 6 | 1.4500 | 67 | 11.7600 | .20000 | 1.69880 |
| 7 | 1.6500 | 157 | 11.6363 | .20000 | 1.95048 |
| 8 | 1.8500 | 247 | 11.4756 | .20000 | 2.20215 |
| 9 | 2.0500 | 337 | 11.2642 | .20000 | 2.45382 |
| 10 | 2.2500 | 67 | 11.0259 | .20000 | 2.70550 |
| 11 | 2.4500 | 157 | 10.7875 | .20000 | 2.95717 |
| 12 | 2.6070 | 247 | 10.6004 | .15700 | 2.49771 |
| 13 | 2.7130 | 337 | 10.4741 | .10600 | 1.77405 |
| 14 | 2.8160 | 67 | 10.3513 | .10300 | 1.79157 |
| 15 | 2.9140 | 157 | 10.2346 | .09800 | 1.76656 |
| 16 | 3.0100 | 247 | 10.1201 | .09600 | 1.78910 |

It will be observed from Table I that the values of DA vary widely across the face of the cutter. The value of DA from cutters 1 to 11 constantly increases. As the value of DA is directly related to the volume of material cut, it can be assumed on average that the higher numbered cutters in this group will wear faster than the lower numbered cutters.

The cutters numbered 12 through 16 are moved radially closer than the arbitrarily selected DR separation of 0.2 inches to limit the increase in the value DA. A drill bit designed according to the dimensions of Table I and as shown in FIGS. 2 and 3 would therefore be expected to have uneven wear on the cutters and become ineffective within a relatively short service life by failure of the cutters having the greatest DA value.

Figure 4:
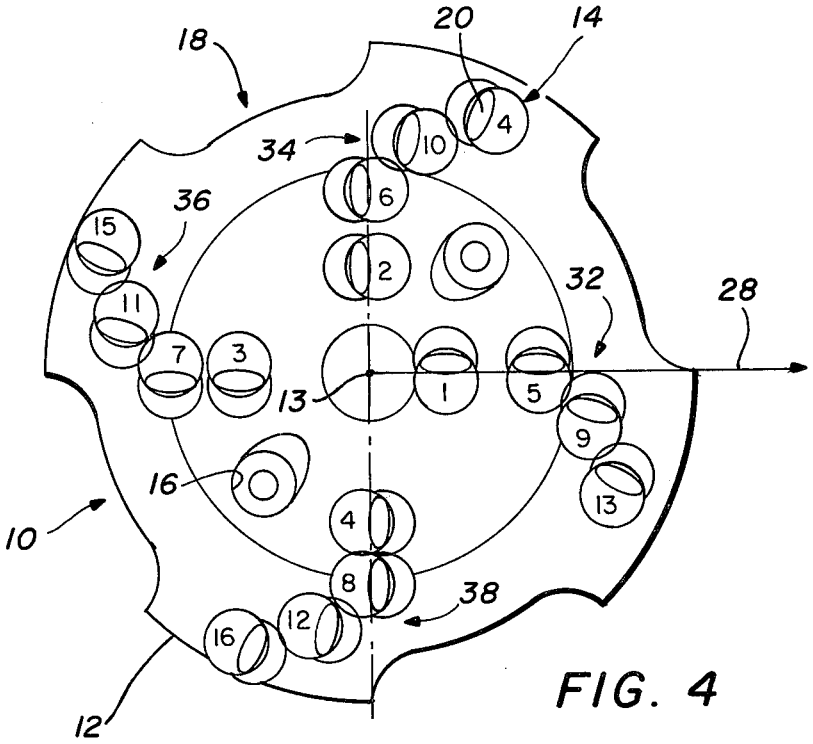
FIG. 4 is an end view of a drill bit showing an intermediate stage in the design of the present invention.
Figure 5:
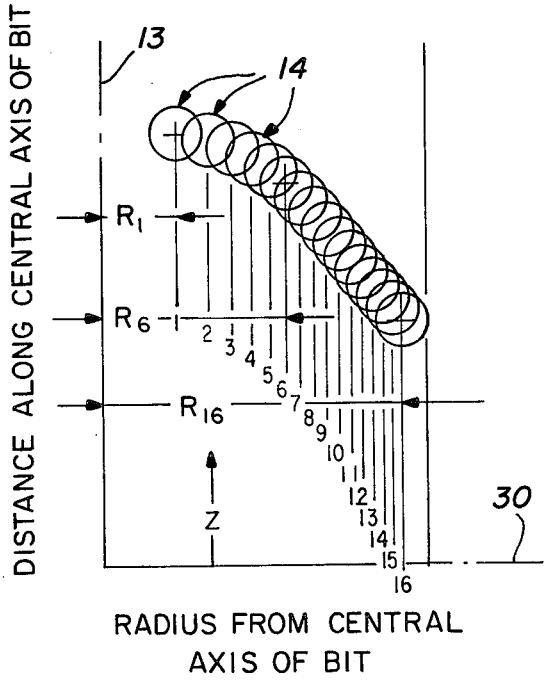
FIG. 5 is a profile drawing of the drill bit of FIG. 4 illustrating the cutters on the drill bit rotated to a single radius.
Figure 6:
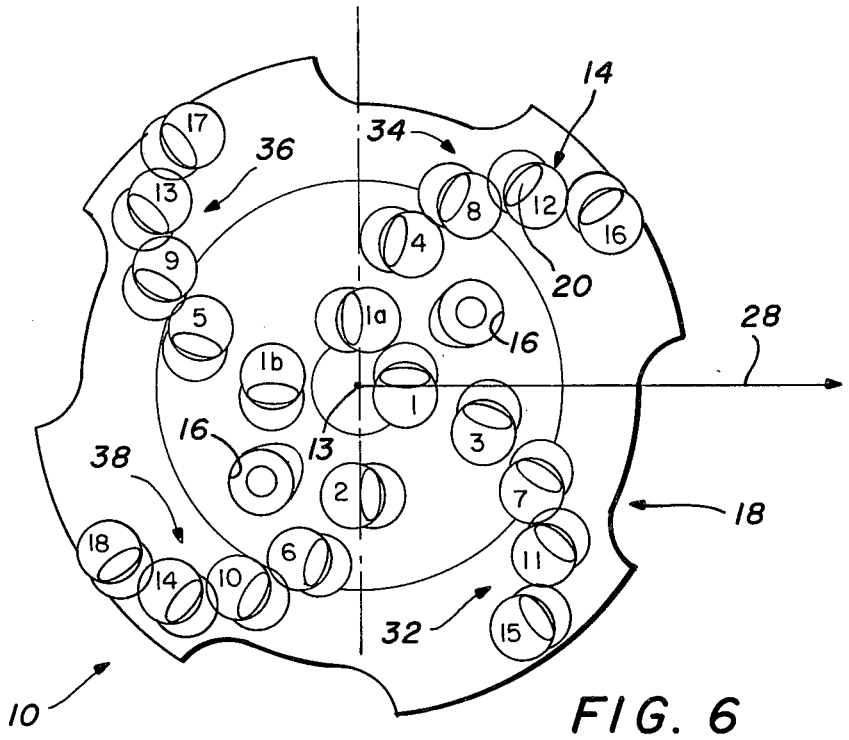
FIG. 6 is an end view of the completed drill bit designed in accordance with the present invention.
Figure 7:
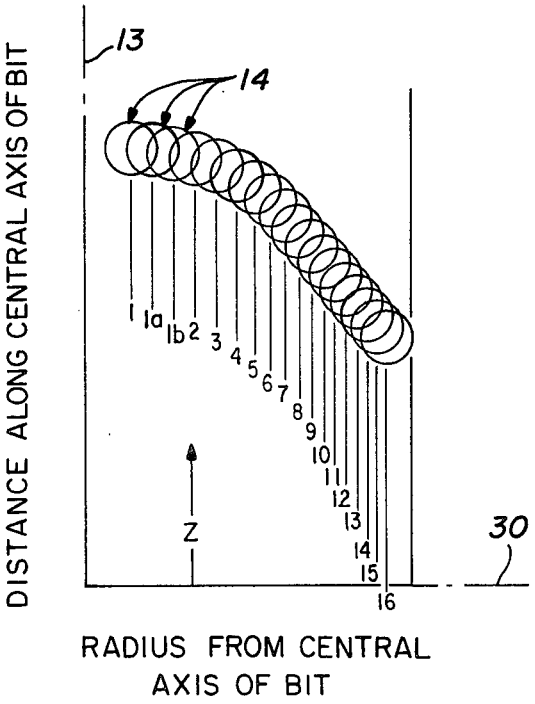
FIG. 7 is a profile drawing of the drill bit of FIG. 6 illustrating the cutters on the drill bit rotated to a single radius.

Referring now to FIGS. 4–7 and Tables II and III herein, a design is presented in accordance with the teachings of the present invention. FIGS. 4 and 5 and Table II represent an intermediate stage in the design process. FIGS. 6 and 7 and Table III represent a final functional design. The design of the present invention attempts to maintain the value of DA constant over a major portion of the bit body. By maintaining the value of DA constant, the distribution of cutters approximate an ideal distribution having substantially constant volume cutting. This permits the wear on the cutters to be relatively uniform and prevents excessive loading on individual cutters which could lead to premature failure. The design also has the significant advantage of greatly simplifying the calculations necessary to position the cutters.

As in the prior art example noted above, the drill bit 10 illustrated in FIGS. 4–7 is designed to drill a 6½ inch diameter hole and has a bit profile, or bottom hole profile, generally as shown in FIG. 7 with the Z value of each cutter decreasing as the R value increases. Thus each cutter has a different axial as well as radial location with respect to any other cutter. The cross sectional area of the hole in a plane perpendicular the direction of drilling is therefore 33.18 square inches. Again, sixteen cutters are provided which therefore form sixteen kerfs or paths cut into the material being drilled.

The cutting face 20 on each cutter is assumed to be circular with a diameter of ½ inch. Cutter No. 16 forms a gauge cutter which defines the wall diameter of the hole. The area of the circle defined by a radius extending from the central axis 13 to the center of the cutting face on cutter No. 16 is therefore the radius of the hole, 3.25 inches, less ½ the radial length of the cutting face, 0.250 inches. This value equals 3.0 inches. The area of the circle is therefore $(\pi)$ (Radius)$^2$ or 28.27 square inches.

The ideal value for DA can then be determined. This value is the area of the circle defined by the radius of the gauge cutter divided by the number of cutters or kerfs desired. For this example the DA value will be 28.27 inches divided by 16, or 1.77 square inches. With this value of DA determined, the radial location of each cutter from the central axis 13 can be readily calculated by the following equation:

$$R = \left(\frac{A}{N} \cdot \frac{X}{\pi}\right)^{\frac{1}{2}}$$

Where:

R=Radius of cutter X

A=Area of circle defined by gauge cutter

N=Total number of cutters

X=Cutter number. $\pi$=3.1415927

The cutter distribution from this equation is illustrated in FIGS. 4 and 5 and Tabulated in Table II.

TABLE II

| Cutter No. | Radius | Angle | Z Value | DR | DA |
|---|---|---|---|---|---|
| 1 | .7530 | 0 | 11.9839 | .75300 | 1.78377 |
| 2 | 1.0640 | 90 | 11.9188 | .31100 | 1.77772 |
| 3 | 1.3030 | 180 | 11.8317 | .23900 | 1.77969 |
| 4 | 1.5050 | 270 | 11.7292 | .20200 | 1.78442 |
| 5 | 1.6830 | 0 | 11.6126 | .17800 | 1.78520 |
| 6 | 1.8430 | 90 | 11.4820 | .16000 | 1.77480 |
| 7 | 1.9910 | 180 | 11.3330 | .14800 | 1.78510 |
| 8 | 2.1280 | 270 | 11.1713 | .13700 | 1.77525 |
| 9 | 2.2580 | 348 | 11.0163 | .13000 | 1.79374 |
| 10 | 2.3800 | 78 | 10.8710 | .12200 | 1.78008 |
| 11 | 2.4960 | 168 | 10.7327 | .11600 | 1.77938 |
| 12 | 2.6070 | 258 | 10.6004 | .11100 | 1.78196 |
| 13 | 2.7130 | 335 | 10.4741 | .10600 | 1.77405 |
| 14 | 2.8160 | 65 | 10.3513 | .10300 | 1.79157 |
| 15 | 2.9140 | 155 | 10.2346 | .09800 | 1.76656 |
| 16 | 3.0100 | 245 | 10.1201 | .09600 | 1.78910 |

It will be noted from the value DR in Table II that maintaining the DA value constant causes the radial separation of radially adjacent cutters to decrease from the central axis 13 to the gauge cutter. If desired, the number of kerfs cut by the drill bit can be substituted for the number of cutters for this equation for Radius.

In practice, however, a drill bit constructed according to the intermediate stage design illustrated in FIGS. 4 and 5 and recorded in Table II would not be effective. For example, the radial location of cutter No. 1 would permit a central core of material to remain uncut. Prior experience has shown that a serviceable position for cutter No. 1 is centered at a radius of 0.45 inches from the central axis 13 for the other parameters in the example presented. Because the diameter of the cutter is ½ inch, this prevents the formation of a center core of material.

In addition, empirical teachings from past operation indicates that a significant overlap of the kerfs for radially adjacent cutters should be provided. A significant overlap in kerfs reduces the likelihood that failure of a single cutter would reduce the effectiveness of the drill bit to nonserviceability. To provide this overlap, designers typically set and arbitrary maximum radial separation between radially adjacent cutters. For a cutter face radial length of 0.5 inches, a 0.25 inch value for DR has been found to be a usable maximum limit. This value can be varied. For example, DR values of 0.2 or 0.3 inches might be desirable in certain environments.

FIGS. 6 and 7 and Table III below illustrate a realistic final design model for drill bit 10 which overcomes the above-noted problems in the intermediate stage model. For the present example, a maximum value for DR will be 0.214 inches. With reference to the ideal constant DA value example in Table II, it can be seen that the maximum permitted value of DR is exceeded in the intervals between cutters 1, 2 and 3. Therefore, additional cutters must be provided radially inward of cutter No. 3 to maintain the maximum desired DR value. Thus the bit body is essentially separated into two zones. The first zone being radially inwardly of cutter No. 3 where the cutters must be located in accordance with a maximum desired radial separation, and a second zone, radially outwardly of cutter No. 3 where the cutters are mounted in accordance with maintaining a generally constant DA value.

With cutter No. 3 located at a radius of 1.303 inches and cutter No. 1 located at 0.45 inches, the number of kerfs needed between cutters 1 and 3 is the difference in these radii divided by the maximum value of DR desired. That is, (1.303−0.45)/0.214, or 3.99 kerfs. Obviously, only a finite integar number of cutters can exist. Therefore, the next larger integer above the kerf needed represents the number of cutters required radially inward of cutter No. 3. Therefore, four cutters must be provided in the first zone. A cutter 1*a* can be positioned at a radius of 0.214 inches from cutter 1. A cutter 1*b* can be positioned at a radius of 0.213 inches from cutter 1*a*. Cutter 2 can then be positioned at mid-radius between the position of cutters 1*b* and 3.

By adding cutters 1*a* and 1*b* in the first zone corresponding to that area of the bit body adjacent the nose, it is apparent that there are now 18 cutters on the body in contrast to the originally selected number of 16; however, the additional cutters were necessitated by the requirement for a radial overlap of radially adjacent cutters which could not be otherwise maintained in the first zone if the distribution of the cutters were based solely on maintaining a constant DA value. Thus, it is apparent that there exists a first zone on the bit body which requires cutter placement according to at least a minimum radial overlap of adjacent cutters, and a second continuous zone, over a major portion of the bit body, where an acceptable overlap of adjacent cutters is able to be maintained even though the cutters are spaced so as to primarily maintain a constant DA value.

TABLE III

| Cutter No. | Radius | Angle | Z Value | DR | DA |
|---|---|---|---|---|---|
| 1 | .4500 | 0 | 12.0000 | .45000 | .63705 |
| 1a | .6640 | 90 | 11.9933 | .21400 | .74998 |
| 1b | .8770 | 180 | 11.9641 | .21300 | 1.03260 |
| 2 | 1.0900 | 270 | 11.9110 | .21300 | 1.31805 |
| 3 | 1.3030 | 343 | 11.8317 | .21300 | 1.60351 |
| 4 | 1.5050 | 73 | 11.7292 | .20200 | 1.78442 |
| 5 | 1.6830 | 163 | 11.6126 | .17800 | 1.78520 |
| 6 | 1.8430 | 253 | 11.4820 | .16000 | 1.77480 |
| 7 | 1.9910 | 331 | 11.3330 | .14800 | 1.78510 |
| 8 | 2.1280 | 61 | 11.1713 | .13700 | 1.77525 |
| 9 | 2.2580 | 11.0163 | .13000 | 1.79374 | |
| | 151 | | | | |
| 10 | 2.3800 | 241 | 10.8710 | .12200 | 1.78008 |
| 11 | 2.4960 | 319 | 10.7327 | .11600 | 1.77938 |
| 12 | 2.6070 | 49 | 10.6004 | .11100 | 1.78196 |
| 13 | 2.7130 | 139 | 10.4741 | .10600 | 1.77405 |
| 14 | 2.8160 | 229 | 10.3513 | .10300 | 1.79157 |
| 15 | 2.9140 | 305 | 10.2346 | .09800 | 1.76656 |
| 16 | 3.0100 | 35 | 10.1201 | .09600 | 1.78910 |

Figure 8:
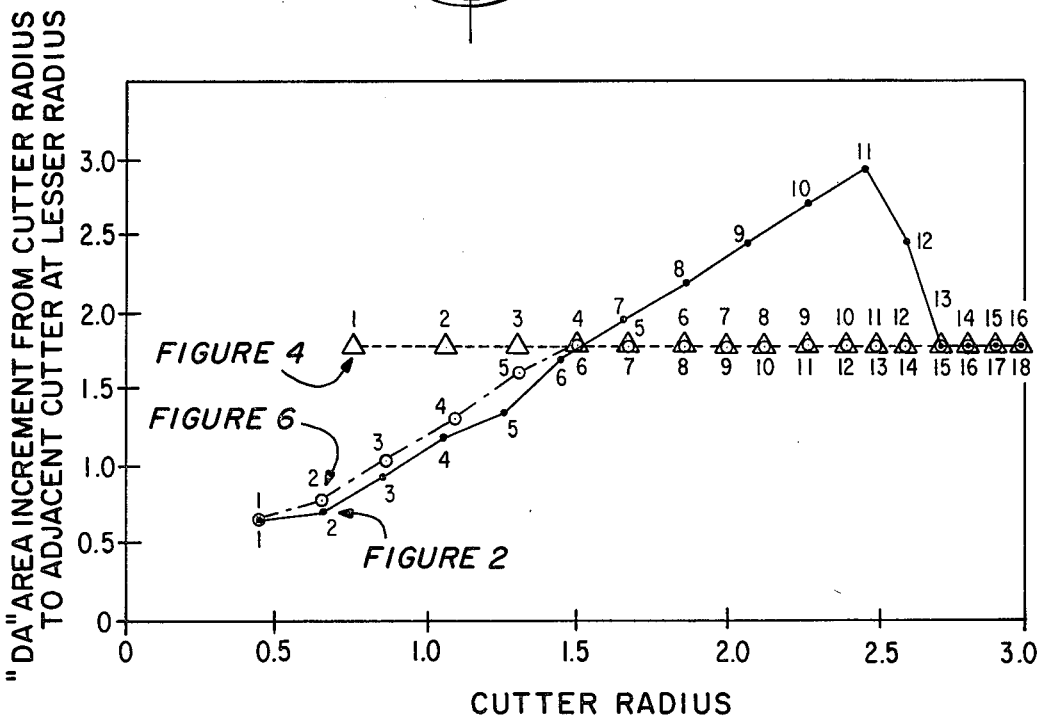
FIG. 8 is a graphical representation of the annular area defined on a plane perpendicular to the central axis of the drill bit between the centers of radially adjacent cutters for the designs of FIGS. 2, 4 and 6.

FIG. 8 graphically represents the incremental area of circles defined by radii of radially adjacent cutters normal to the central axis for the designs of FIGS. 2, 4 and 6. It can be readily observed that the prior art design of FIG. 2 permits large variation in the value of DA with the resultant disadvantages noted previously. The intermediate design model of FIG. 4 forms a straight line curve, representing a constant value of DA. The design of FIG. 6 illustrates the variation in the value of DA necessitated by the design constraints to maintain a kerf overlap and prevent a central core. However, the design of FIG. 6 does not require any value of DA to exceed the predetermined ideal design model value of DA for the conditions assumed.

The design of the present invention therefore provides a simple and powerful tool for designing drill bits. The design approaches the ideal of having each individual cutter cutting equal volumes of material to equalize wear and prevents overload on a given cutter. However, the design avoids the complexities of the ideal case calculation.

Although a single embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A drill bit comprising:

a body having a central axis;

a plurality of cutters attached to said body and comprising a first group of cutters and a supplemental group of cutters, each of said cutters during rotation of said bit defining a circular area perpendicular the central axis having a radius centered on the central axis and extending to the center of the cutting face of the cutter and with at least three radially consecutive cutters in each group located at different axial dimensions from a common plane perpendicular to said central axis, and wherein the cutters in said first group are positioned on the body so that the difference in circular areas defined by any cutter thereof and the circular area defined by the next radially adjacent cutter thereof is generally constant and does not exceed a predetermined area value; and wherein said cutters of said supplemental group are positioned on the body on radii smaller than any radius of a cutter in the first group and generally adjacent the central axis of said body and overlapping radial adjacent cutters of said supplemental group by at least a minimum radial increment to provide a continuous cut of material from the cental axis radially outward to the cutter at the greatest radial distance.

2. The drill bit of claim 1 wherein the number of cutters in said first group is sufficient to determine a positioning thereof on the body so that the kerfs cut thereby in the material overlap.

3. The drill bit of claim 2 wherein the difference between the radius of a first cutter and the radius of the next radially adjacent cutter is no more than 60% of the radial length of the cutting face of either of said cutters extending along a radius centered at the central axis.

4. A drill bit, comprising:

a body having a central axis;

a plurality of cutters attached to said body, each of said cutters having a circular cutting face for contacting a material to be drilled and during rotation of said bit about said central axis, defining a circle perpendicular to the central axis formed with a radius centered on the central axis extending to the center of the cutting face of the cutter and with at least three radially consecutive cutters located at different axial dimensions from a common plane perpendicular to said central axis, the cutters disposed throughout a first continuous portion of the body being positioned so that the annular area between the circles of radially adjacent cutters therein is a substantially constant value.

5. The drill bit of claim 4 wherein radially adjacent cutters have a predetermined maximum radial separation.

6. The drill bit of claim 5 wherein the kerfs formed by each of said cutters overlap.

7. The drill bit of claim 5 wherein cutters are attached to another continuous portion of said body closer to the central axis than said first continuous portion with the annular area between the circle of any given cutter and the circle of the next greater cutter is equal to or less than said substantially constant value.

8. The drill bit of claim 4 wherein the difference between the radii of radially adjacent cutters is no more than 60% of the diameter of the cutting face of said cutters.

9. A drill bit comprising a body having a central axis and a plurality of cutters mounted thereon, each cutter defining a circle of revolution perpendicular to the central axis formed with a radius centered on the central axis extending to the center of the face of said cutter, said body having a first cutting zone and a second cutting zone and with at least three radially consecutive cutters in each zone located at different axial dimensions from a common plane perpendicular to said central axis, wherein:

the cutters in said first zone are positioned relative to each radially adjacent cutter therein according to a maximum radial increment being less than the radial dimension of the cutter face; and, the cutters in said second zone are positioned such that the annular areas between circles of radially adjacent cutters are substantially constant throughout said second zone and greater than the annular areas between the cutters in said first zone.

10. Structure according to claim 9 wherein the radius of each cutter in the first zone is less than the radius of each cutter in the second zone.

* * * * *